US007596975B1

(12) United States Patent
Yuan et al.

(10) Patent No.: US 7,596,975 B1
(45) Date of Patent: Oct. 6, 2009

(54) LOCK MECHANISM

(76) Inventors: Zhi Man Yuan, Dong An High Way, Haizhou, Zhongshan City, Guandong (CN); Xiang Bei Zou, Dong An High Way, Haizhou, Zhongshan City, Guangdong (CN); Gua Hua Liu, Dong An High Way, Haizhou, Zhongshan City, Guangdong (CN)

( * ) Notice: Subject to any disclaimer, the term of this patent is extended or adjusted under 35 U.S.C. 154(b) by 0 days.

(21) Appl. No.: 11/644,466

(22) Filed: Dec. 21, 2006

(51) Int. Cl.
*E05B 9/06* (2006.01)

(52) U.S. Cl. ..... 70/134; 70/370; 70/373; 70/417; 70/448; 70/451

(58) Field of Classification Search ..... 70/134, 70/370–373, 381, 417, 447–449, 451, 452, 70/DIG. 60, DIG. 61
See application file for complete search history.

(56) References Cited

U.S. PATENT DOCUMENTS

| | | | | | |
|---|---|---|---|---|---|
| 900,620 | A * | 10/1908 | Voight | 70/451 |
| 4,012,929 | A * | 3/1977 | Solovieff | 70/134 |
| 4,073,172 | A * | 2/1978 | Schlage | 70/417 |
| 4,272,974 | A * | 6/1981 | Hennessy | 70/129 |
| 4,338,804 | A * | 7/1982 | Solovieff | 70/134 |
| 4,587,816 | A * | 5/1986 | Garcia | 70/417 |
| 5,216,910 | A * | 6/1993 | Lin | 70/370 |
| 5,249,444 | A * | 10/1993 | Dancs | 70/380 |
| 5,251,513 | A * | 10/1993 | Asada | 477/163 |
| 5,335,525 | A * | 8/1994 | Solovieff | 70/370 |
| 5,722,273 | A * | 3/1998 | Lin et al. | 70/370 |
| 5,881,590 | A * | 3/1999 | Small | 70/451 |
| 6,230,528 | B1 * | 5/2001 | Don et al. | 70/370 |
| 6,959,567 | B2 * | 11/2005 | Huang et al. | 70/370 |
| 2005/0011240 | A1 * | 1/2005 | Huang et al. | 70/370 |
| 2006/0065025 | A1 * | 3/2006 | Viviano et al. | 70/134 |
| 2006/0096345 | A1 * | 5/2006 | Chen | 70/493 |
| 2006/0179904 | A1 * | 8/2006 | Shen | 70/370 |
| 2008/0121002 | A1 * | 5/2008 | Sun et al. | 70/124 |

* cited by examiner

*Primary Examiner*—Lloyd A Gall
(74) *Attorney, Agent, or Firm*—William G. Lane

(57) ABSTRACT

An improved lock mechanism comprising an anti-pry shield having a hollow body with a first end and a second end, and a cylindrical shield at its first end; a knob-set cylinder having a plug with a key end and a driver end; a monolithic cylinder guard having a body with a beveled exterior side wall between a first end and a second end, the second end having a bore, a cylinder receiver having a cavity open to the first end, the cavity adapted to receive the knob-set cylinder from the first end, the cavity open to the bore in the second end, the bore adapted to receive the key end of the plug; and a cover having a beveled exterior side wall between an open first end and a covered second end, the decorative cover permanently secured to and covering the beveled exterior side wall and the second end of the monolithic cylinder guard, the covered second end of the cover having a bore coaxial with the bore in the second end of the monolithic cylinder guard and the plug of the knob-set cylinder.

13 Claims, 5 Drawing Sheets

LOCK MECHANISM

FIELD OF THE INVENTION

The present invention is directed to an improved cylinder lock mechanism. In particular, it is directed to an improved cylinder lock mechanism for single cylinder and double cylinder dead bolt locks.

BACKGROUND OF THE INVENTION

The exterior doors of most residences and business today are secured with a keyed lock dead bolt. Such door locks have been available for over a century and have served well. Most of the parts for such door locks were made of brass. However starting the latter years of the twentieth century, steel started to be used for many of the lock components, especially for components of the dead bolt locking assembly (also referred to as the "locking mechanism" herein). Most door keyed cylinder lock assemblies (also referred to as "lock mechanisms" herein) have a cylinder guard (also known as a cylinder ring). The cylinder guard receives a cylindrical lock cylinder (also known as a cylinder) or it receives a cylindrical body which in turn receives a knob-set (lock) cylinder (also known as a key-in-knob cylinder of cylinder or cylinder lock). The cylinder guard, the cylindrical lock cylinder, the cylindrical body, and/or the knob-set cylinder are made of brass. Brass offers many advantages. Brass to some extent is self-lubricating, it is relatively resistant to corrosion, it is easy to cast or mold, it is easy to machine, and it is an attractive metal rich in warm golden tones. Unfortunately, even in view of these attractive features, it has one major drawback. It is relatively expensive compared to some other metals, such as iron, steel, aluminum and zinc. Unfortunately these metals have disadvantages, such as corrosion properties, lack of strength (excluding steel), not as decorative as brass, not self-lubricating, difficult or challenging to mold or cast (excluding zinc and cast iron), not easy to machine (excluding steel), and the like.

Keyed cylinder locks are relatively secure as long as the cylinder cannot be breached. The cylindrical lock cylinders are protected by the mass of the cylindrical lock cylinder housing and the cylinder guard and knob-set cylinders are protected by the cylinder body which holds the knob-set cylinder and is received in the cylinder guard. All these components are relatively large.

Keyed lock dead bolts in doors are relatively secure as long as the dead bolt assembly cannot be breached. If the actuator or actuator assembly of a dead bolt assembly can be reached with an ice pick or similar small diameter implement, the bolt can frequently be defeated quickly and without noise. For this reason, keyed cylinder locks frequently have a shield, such as an anti-pry shield, secured to the cylinder lock mechanism. Many of these shields only extend to, or slightly in, the opening in the door for the bore that receives the lock mechanism and the locking mechanism. The shields do not extend to and cover the actuator of a dead bolt assembly because the shield is secured to the cylinder lock mechanism and it cannot be moved or rotated in the event the lock mechanism or/and the locking mechanism is misaligned. The lock assemblies, i.e. the assembly of lock mechanism and locking mechanism, are made to be somewhat universal to fit on doors having thicknesses of from about 1⅜ to about 1¾ inches. If the shield extended much beyond the back of the lock mechanism, the lock assemblies could not be used on thin doors, such as 1¼ inch thick doors.

It is an object of the present invention to provide a cylinder lock that is secure as existing cylinder locks but uses less brass.

It is another object of the present invention to provide a cylinder lock that uses less brass than existing cylinder locks but uses brass where brass is the material of choice.

It is a further object of the present invention to provide a cylinder lock that uses a knob-set cylinder in a cylinder lock without the need to use a cylinder body for the knob-set cylinder.

It is still an object to provide a cylinder lock wherein the cylinder guard receives the knob-set cylinder without the need for a separate cylinder body.

It is a further object of the present invention to provide a cylinder lock that has a shield that extends from the lock mechanism to and including the locking mechanism.

It is still a further object of the present invention to provide a cylinder lock that has a shield that extends from the lock mechanism to and including the locking mechanism, and is rotatable with respect to the lock mechanism.

SUMMARY OF THE INVENTION

The present invention is directed to an improved lock mechanism comprising an anti-pry shield having a hollow body with a first end and a second end, and a cylindrical shield at its first end; a knob-set cylinder having a plug with a key end and a driver end; a monolithic cylinder guard having a body with a beveled exterior side wall between a first end and a second end, the second end having a bore, a receiver having a cavity open to the first end, the cavity adapted to receive the knob-set cylinder from the first end, the cavity open to the bore in the second end, the bore adapted to receive the key end of the plug; and a cover having a beveled exterior side wall between an open first end and a covered second end, the cover permanently secured to and covering the beveled exterior side wall and second end of the monolithic cylinder guard, the covered second end of the cover having a bore coaxial with the bore in the second end of the monolithic cylinder guard and the plug of the knob-set cylinder. By monolithic cylinder guard is meant is single piece cylinder guard where the receiver for the knob-set cylinder is an integral part of the cylinder guard, not a separate piece, like the cylinder body for the knob-set cylinder commonly used in locks.

Preferably the monolithic cylinder guard has an annular groove around the receiver open to the first end. Preferably the anti-pry shield has a cylindrical flange at its second end adapted to be received within the groove.

In one preferred embodiment, the cylinder shield has diametrically opposing cutouts in the cylinder shield open to the first end and adapted to receive the actuator of a dead bolt.

Preferably the cylinder guard body has an annular support plate at its first end with an outer circumference and inner circumference and a first side and second side, a planar closed second end with an outer circumference, a cylindrical frame having an inner side and an outer side extending from the outer circumference of the second end to the inner circumference of the first end, and a plurality of ribs extending radially outward from the outer side of the cylindrical frame and extending axially from the first side of the annular support plate toward the second end of the cylinder guard.

Preferably, the monolithic cylinder guard is a zinc alloy piece. By zinc alloy, it is meant zinc metal and alloys of zinc and other metals.

In one embodiment, the securing means is a threaded screw received in the receiver to secure the knob-set cylinder in the receiver.

In the preferred embodiment the improved lock mechanism includes a torque bar secured to the drive end of the plug adapted to actuate a dead bolt locking mechanism.

In the preferred embodiment, the improved lock mechanism comprises: an anti-pry shield having a hollow body with first and second opposing ends, a cylindrical shield at the first end and a cylindrical flange at the second end, the cylinder shield having diametrically opposing cutouts open to the first end and adapted to receive the actuator of a dead bolt; a knob-set cylinder having a plug with a key end and a driver end; a monolithic cylinder guard having a body with an annular support plate at its first end with an outer circumference and inner circumference and a first side and second side, a planar closed second end with an outer circumference, a cylindrical frame having an inner side and an outer side extending from the outer circumference of the second end to the inner circumference of the first end, and a plurality of ribs extending radially outward from the outer side of the cylindrical frame and extending axially from the first side of the annular support plate toward the second end of the cylinder guard, the body having a beveled exterior side wall between a first end and a second end, the second end having a bore, a receiver having a cavity open to the first end, the cavity adapted to receive the knob-set cylinder from the first end, the cavity open to the bore in the second end, the bore adapted to receive the key end of the plug, an annular groove around the cylinder receiver open to the second end and adapted to receive the cylindrical flange of the anti-pry shield, the monolithic cylinder guard receiving a threaded screw on the receiver to securing the knob-set cylinder in the receiver; and a cover having a beveled exterior side wall between an open first end and a covered second end, the cover permanently secured to and covering the beveled exterior side wall and second end of the monolithic cylinder guard, the covered second end of the cover having a bore coaxial with the bore in the second end of the monolithic cylinder guard and the plug of the knob-set cylinder.

In this preferred embodiment, the cylinder guard body has an annular support plate at its first end with an outer circumference and inner circumference and a first side and second side, a planar closed second end with an outer circumference, a cylindrical frame having an inner side and an outer side extending from the outer circumference of the second end to the inner circumference of the first end, and a plurality of ribs extending radially outward from the outer side of the cylindrical frame and extending axially from the first side of the annular support plate toward the second end of the cylinder guard.

In this preferred embodiment, the improved lock mechanism includes a torque bar secured to the drive end of the plug.

DESCRIPTION OF THE INVENTION

Figure 1:
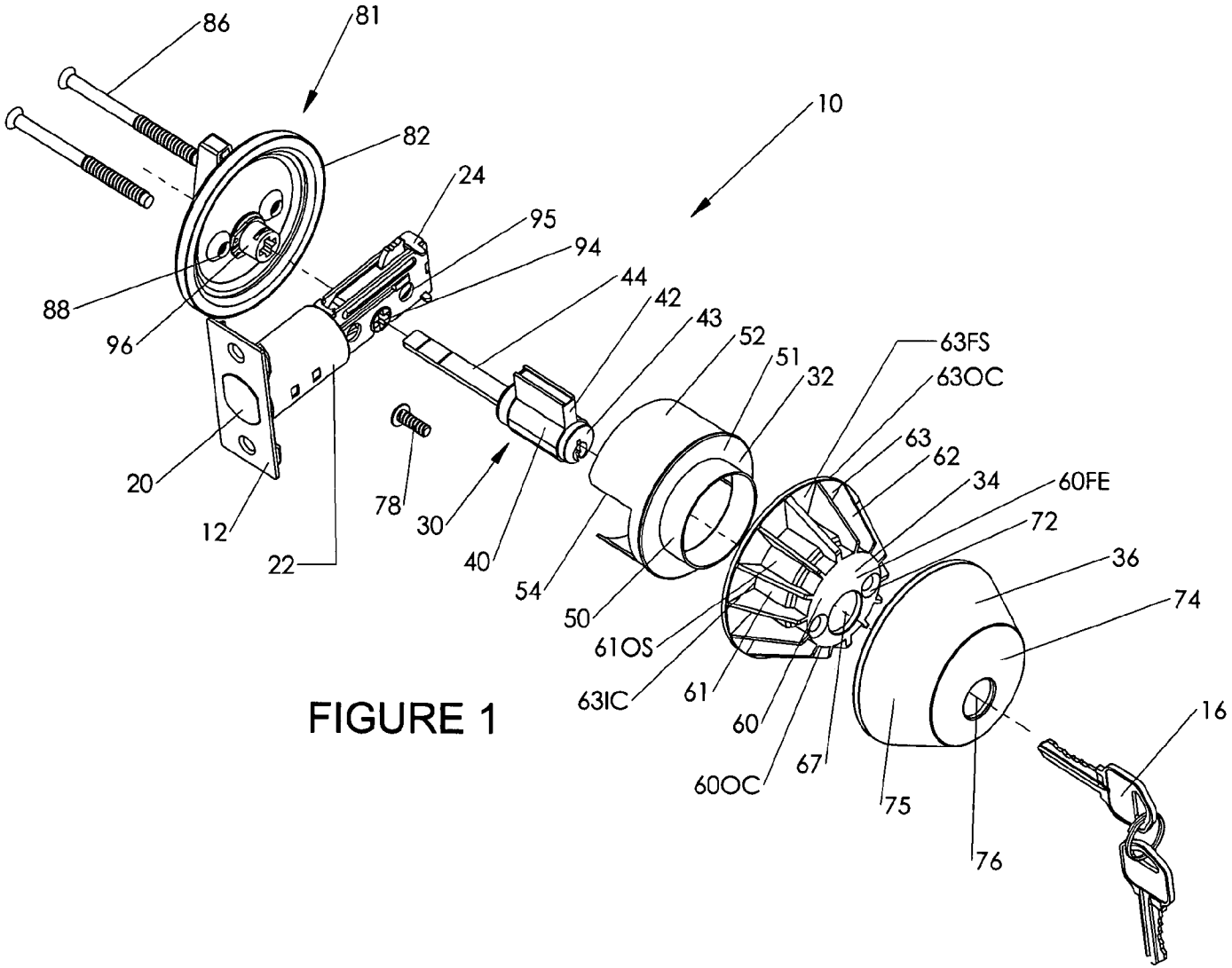
FIG. 1 is a front top telescopic perspective view of a single cylinder dead bolt door lock employing the cylinder lock mechanism of the present invention.
Figure 2:
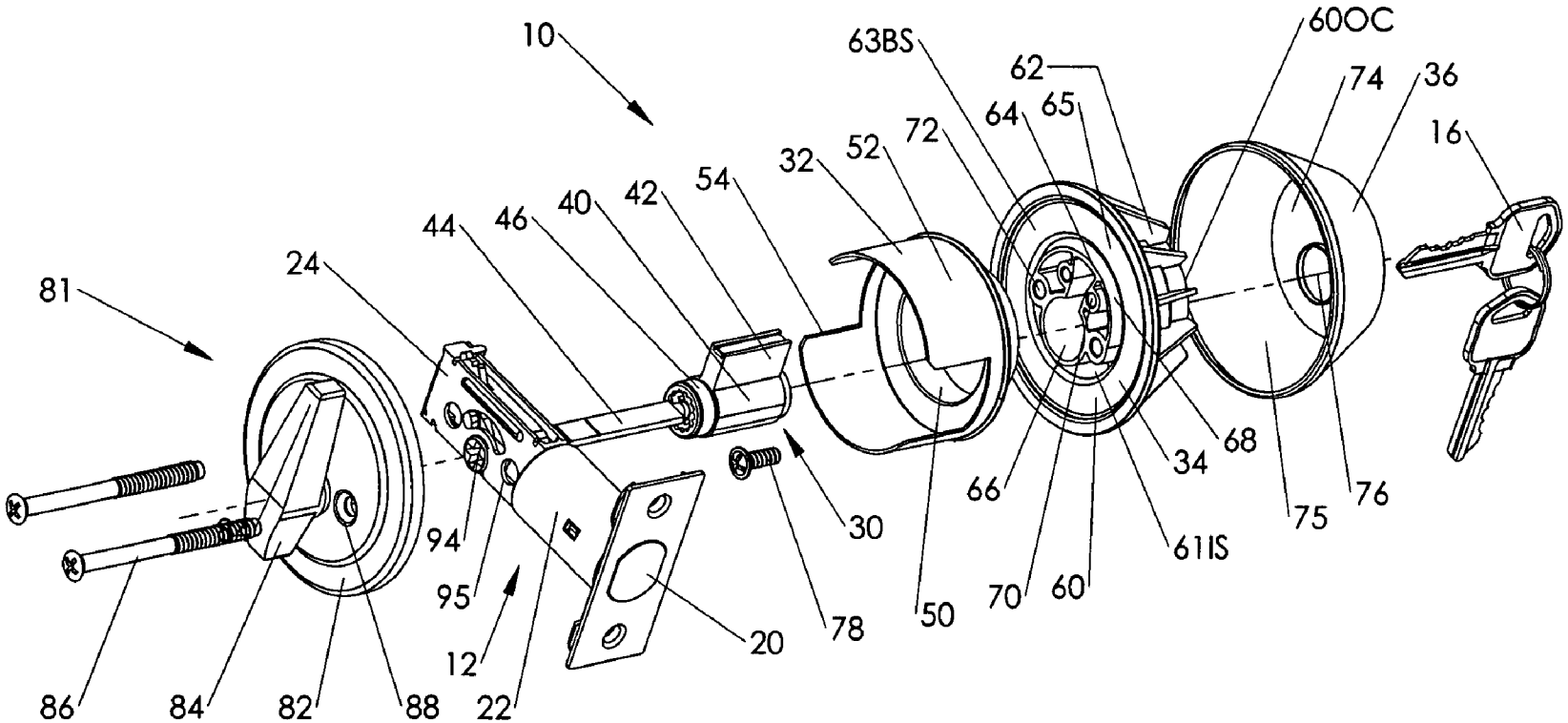
FIG. 2 is a rear top telescopic perspective view of the single cylinder dead bolt door lock of FIG. 1.
Figure 4:
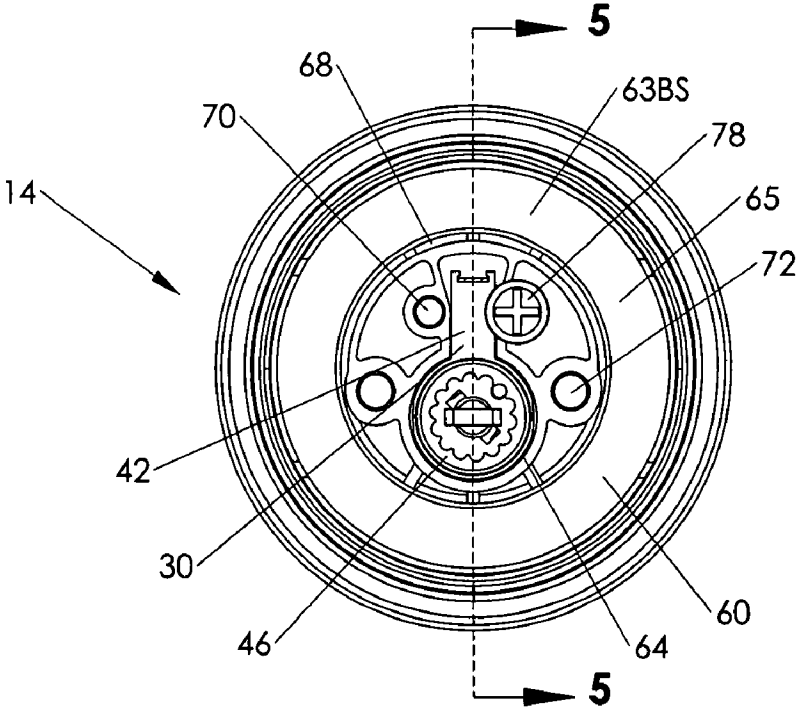
FIG. 4 is a rear plan view of the assembled cylinder lock mechanism of FIG. 1.
Figure 5:
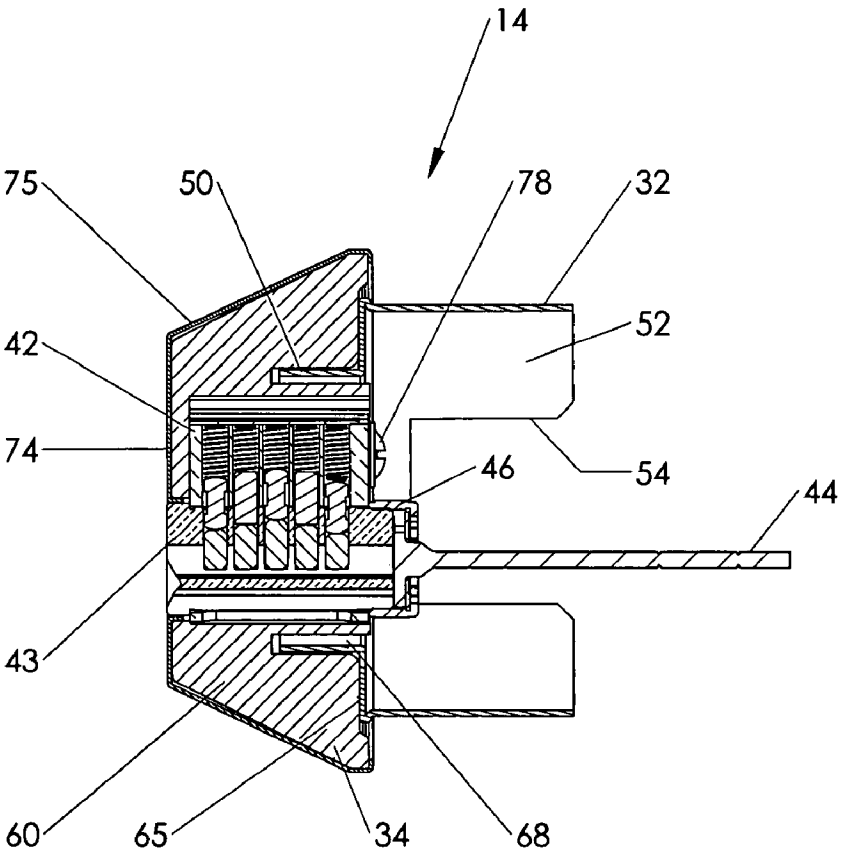
FIG. 5 is set back cross-sectional view along lines 5-5 of FIG. 4.
Figure 6:
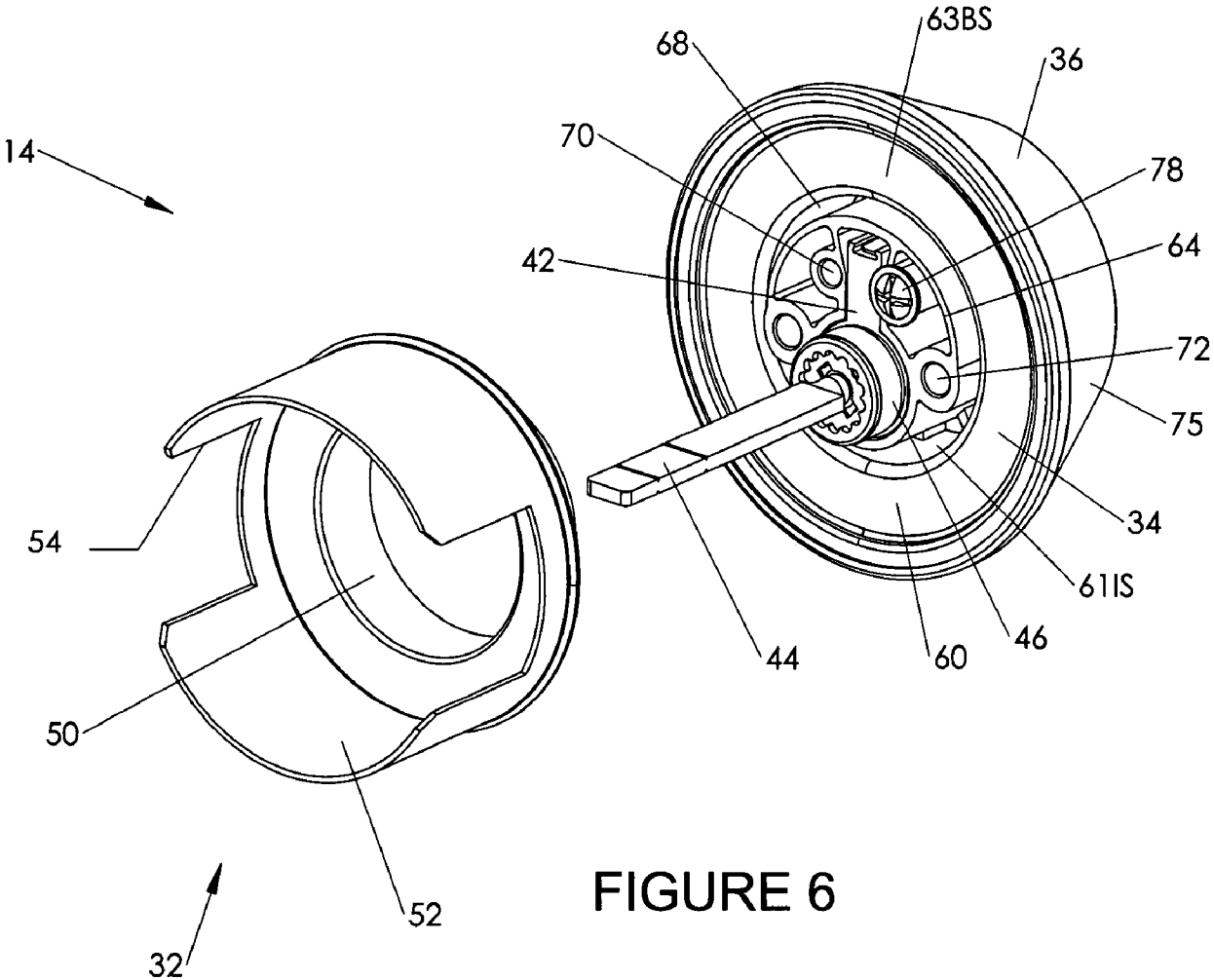
FIG. 6 is a rear top partial telescopic perspective view of a partially assembled cylinder lock mechanism of FIG. 1.

Referring to FIGS. 1 and 2, the single cylinder dead bolt door lock 10 of the present invention comprises a dead bolt locking mechanism 12, a cylinder lock mechanism 14 (FIGS. 4, 5, and 6), and keys 16 for the locking and unlocking the cylinder lock mechanism.

The dead bolt locking mechanism 12 is of conventional design and includes a dead bolt 20 in a housing 22. The dead bolt is extended and retracted out of the housing by the actuator 24 when the T-slot cam 94 is rotated by the torque bar 44 (also called the cylinder bar) by the cylinder lock mechanism when a key is inserted in the key slot in the key end of the cylinder plug 43 of the knob-set cylinder 30 and turned or when the lever 84 of the turn piece assembly 82 is turned.

The cylinder lock mechanism 14 comprises a knob-set cylinder 30 (also called a key-in-knob cylinder, knob cylinder, lock cylinder and cylinder), an anti-pry shield 32 (also called a shield), a cylinder guard 34 (also known as a cylinder ring or cylinder collar), and a cylinder guard cover 36 (also known as a cylinder cover or cover). The knob-set cylinder 30 is of conventional design and includes a cylinder body 40 (also known as a cylinder body, body, cylinder housing, housing, cylinder shell, and shell), a bible 42 that has pin chambers (see FIG. 5) for the pin tumblers and springs, a cylinder plug 43 (also known as the plug and cylinder barrel) with a key end shown in FIG. 1 with a key slot for a key 16 and a driver end shown in FIG. 2 connected to the torque bar 44 by cylinder cap 46.

The anti-pry shield 32 comprises an annular flange 50 at its front end and a cylindrical shield 52 at its back end. The cylindrical shield has two diametrically opposed cutouts 54 adapted to fit around the actuator 24 of the dead bolt locking mechanism 12. The shield protects the torque bar 44, the actuator 24, and the mounting screws 86 from manipulation from the exterior.

The cylinder guard 34 (also sometimes referred to as the cylinder ring or cylinder collar) has a monolithic body 60 with an annular support plate 63 at its back end with an outer circumference 63 OC and inner circumference 63 IC and a front side 63 FS and a back side 63 BS, a planar closed front end 60 FE (See FIG. 1) with an outer circumference 60 OC, a cylindrical frame 61 having an inner side 61 IS and an outer side 61 OS extending axially from the outer circumference of the planar closed front end 60 FE to the inner circumference of the front end of the annular support plate 63, and a plurality of ribs 62 extending radially outward from the outer side of the cylindrical frame 61 and extending axially from the front side of the annular support plate 63 toward the front end of the cylinder guard 34. The exterior ribs of the cylinder guard reinforce the guard and the cover, which is secured to the guard. The rib construction minimizes the amount of metal required to form the guard thus reducing weight of the guard, which saves in transportation costs and reduces the amount of material reducing material costs.

The monolithic body 60 has a receiver 64 with a cavity 66 adapted to receive the knob-set cylinder 30. The planar closed front end of the monolithic body has a hole 67 adapted to receive the key end of the cylinder plug 43 (See FIGS. 1 and 5). The depth of the cavity 66 is equivalent to the length of the bible 42 so that the back end of the bible is co-planar or slightly less than co-planar with the back end of the receiver. A threaded screw 78 is threadingly received in one of the threaded bores 70 to retain the bible and the knob-set cylinder in the cavity and receiver (See FIGS. 4 and 5). The backside of the annular support plate 63 has an annular inset 65 adapted to receive the annular wall 51, of the anti-pry shield 32, that joins the retaining flange 50 and the cylindrical shield 52.

Figure 3:
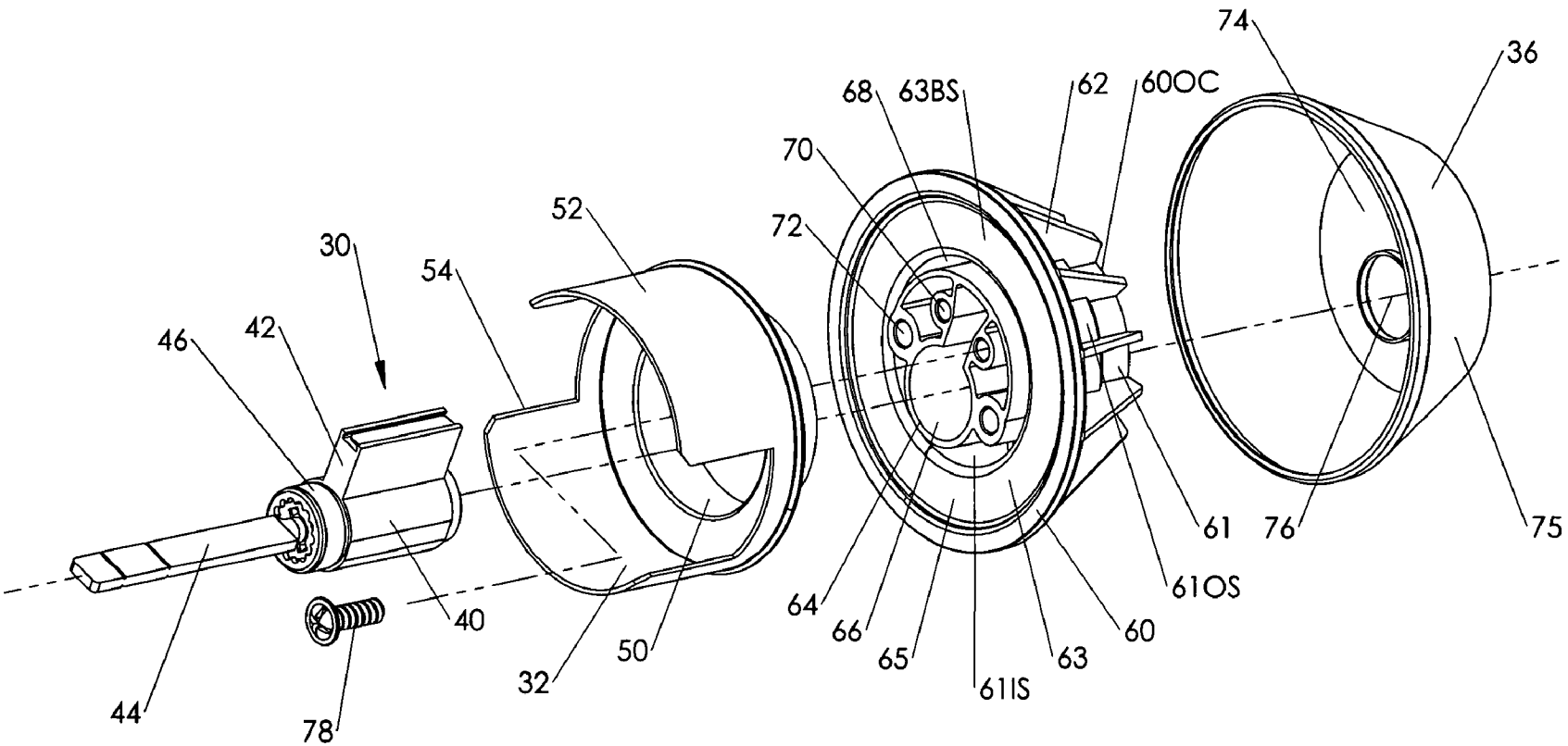
FIG. 3 is a rear top telescopic perspective view of the cylinder lock mechanism of FIG. 1.

An annular groove 68 (FIG. 3) separates the receiver 64 from the inner side of the cylindrical frame 61 of the monolithic body 60. The annular flange 50 of the anti-pry shield is adapted to be received within the annular groove 68. The anti-pry shield is free to turn within the groove and to move axially within the groove until the shield engages the actuator 24 of the dead bolt locking mechanism 12. This freedom of movement allows assembly of the dead bolt door lock even when the alignment of the components is not perfect.

The cylinder guard cover 36 (also called the cylinder cover and cover) is received on the cylinder guard monolithic body 60 with the planar closed front end of the body in contact with the inside of the face 74 of the cylinder guard cover 36, the ribs in contact with the inside of the beveled side wall 75 of the cover, and the hole 76 of the cover axially aligned with hole 67 of the cylinder guard and the cylinder plug 43 to provide access for key 16 to the key slot in the cylinder plug. The cover 36 is permanently secured to the cylinder guard by crimping or rolling the rear edge of the beveled sidewall 75 around the outer circumference of the annular support plate 63 of the monolithic body 60 (see FIG. 5). However other well-known means may be used to secure the cover to the cylinder guard.

For a single cylinder dead bolt door lock, the interior of the door is fitted with a turn piece assembly 81 comprising mounting plate 82, a lever 84 mounted for turning in the mounting plate, mounting screws 86 which are received in and pass through holes 88. The torque bar 44 passes through the T-slot of the T-slot cam 94 and engages the slot in hub 96 connected to the lever 84. When the lever 84 is turned, the hub 96, T-slot cam 94, and the torque bar 44 are turned to unlock or lock the dead bolt locking mechanism by retracting in or advancing out the dead bolt 20 from the housing 22. The mounting screws 86 extend through holes 95 in the actuator 24 of the dead bolt locking mechanism 12 and through the opening defined by the annular flange 50 of the anti-pry shield 32 into threaded holes 72 in the cylinder guard. The mounting screws are tightened down to advance the cylinder lock mechanism 14 and turn piece assembly 81 toward each other to securely engage the keyed cylinder lock assembly to the exterior surface and the interior surface of the door respectively.

A double cylinder dead bolt door lock (not shown) is very similar to the single cylinder dead bolt door lock with the exception that the turn piece assembly 81 is replaced with another cylinder lock mechanism. The interior cylinder lock mechanism is very similar to the exterior cylinder lock mechanism describe above with the exception that the interior locking mechanism does not have an anti-pry shield, and the retainer cap 46 on the knob-set cylinder 30 is replaced with a hub similar to hub 96 to receive the torque bar 44. In addition, the cylinder guard of the interior locking mechanism has two non-threaded holes, located as threaded holes 72 in the cylinder guard 34, to receive mounting screws which extend through the non-threaded holes, and holes 95 in the actuator 24 into holes 72 in the cylinder guard 34. Optionally the cylinder guard cover of the interior cylinder lock mechanism does not have holes to receive the mounting screws. In that embodiment, the mounting screws extend from the non-threaded holes of the interior cylinder guard, but not the cover. The interior cover hides the head of the mounting screws and the cover is secured to interior cylinder guard of the interior lock mechanism with a simple screw(s) through a hole(s) in the cover and received in a threaded hole(s) in the front side or face of the interior cylinder guard.

The invention has been described directed to one embodiment. The invention however is not limited to that embodiment and the invention encompasses variants that are obvious in the view of the invention described herein.

What is claimed is:

1. An improved lock mechanism comprising:

an anti-pry shield having a hollow body with a first end and a second end, and a cylindrical shield at its first end, the anti-pry shield having a cylindrical flange at its second end;

a knob-set cylinder having a plug with a key end and a driver end;

a monolithic cylinder guard having a body with a beveled exterior side wall between a first end and a second end, the second end having a bore, a cylinder receiver having a cavity open to the first end, the cavity adapted to receive the knob-set cylinder from the first end, the cavity open to the bore in the second end, the bore adapted to receive the key end of the plug, the monolithic cylinder guard having an annular groove around the cylinder receiver open to the first end, the cylindrical flange of the anti-pry shield adapted to be received within the groove; and a cover having a beveled exterior side wall between an open first end and a covered second end, the cover permanently secured to and received on the monolithic cylinder guard, the covered second end of the cover having a bore coaxial with the bore in the second end of the monolithic cylinder guard and the plug of the knob-set cylinder.

2. The improved lock mechanism according to claim 1 wherein the anti-pry shield has diametrically opposing cutouts in the cylindrical shield open to the first end and adapted to receive the actuator of a dead bolt.

3. The improved lock mechanism according to claim 2 wherein the cylinder guard body has a has an annular support plate at its first end with an outer circumference and inner circumference and a first side and second side, a planar closed second end with an outer circumference, a cylindrical frame having an inner side and an outer side extending from the outer circumference of the planar closed second end to the inner circumference of the first end, and a plurality of ribs extending radially outward from the outer side of the cylindrical frame and extending axially from the first side of the annular support plate toward the planar closed second end of the cylinder guard.

4. The improved lock mechanism according to claim 1 wherein the cylinder guard body has an annular support plate at its first end with an outer circumference and inner circumference and a first side and second side, a planar closed second end with an outer circumference, a cylindrical frame having an inner side and an outer side extending from the outer circumference of the planar closed second end to the inner circumference of the first end, and a plurality of ribs extending radially outward from the outer side of the cylindrical frame and extending axially from the first side of the annular support plate toward the planar closed second end of the cylinder guard.

5. The improved lock mechanism according to claim 4 wherein the monolithic cylinder guard is a zinc alloy piece.

6. The improved lock mechanism according to claim 1 wherein the cylindrical shield has diametrically opposing cutouts open to the first end and adapted to receive the actuator of a dead bolt; and the body of the monolithic cylinder guard has an annular support plate at its first end with an outer circumference and inner circumference and a first side and second side, a planar closed second end with an outer circumference, a cylindrical frame having an inner side and an outer side extending from the outer circumference of the planar closed second end to the inner circumference of the first end, and a plurality of ribs extending radially outward from the outer side of the cylindrical frame and extending axially from the first side of the annular support plate toward the planar closed second end of the cylinder guard.

7. An improved lock mechanism comprising:

an anti-pry shield having a hollow body with first and second opposing ends, a cylindrical shield at the first end and a cylindrical flange at the second end, the cylindrical shield having diametrically opposing cutouts open to the first end and adapted to receive the actuator of a dead bolt;

a knob-set cylinder having a plug with a key end and a driver end;

a monolithic cylinder guard having a body with a beveled exterior side wall between a first end and a second end, the second end having a bore, a receiver having a cavity open to the first end, the cavity adapted to receive the knob-set cylinder from the first end, the cavity open to the bore in the second end, the bore adapted to receive the key end of the plug, an annular groove around the cylinder receiver open to the first end and adapted to receive the cylindrical flange of the anti-pry shield, the monolithic cylinder guard having means for securing the knob-set cylinder in the receiver; and a cover having a beveled exterior side wall between an open first end and a covered second end, the cover permanently secured to and received on the monolithic cylinder guard, the covered second end of the cover having a bore coaxial with the bore in the second end of the monolithic cylinder guard and the plug of the knob-set cylinder.

8. The improved lock mechanism according to claim 7 wherein the cylinder guard body has an annular support plate at its first end with an outer circumference and inner circumference and a first side and second side, a planar closed second end with an outer circumference, a cylindrical frame having an inner side and an outer side extending from the outer circumference of the planar closed second end to the inner circumference of the first end, and a plurality of ribs extending radially outward from the outer side of the cylindrical frame and extending axially from the first side of the annular support plate toward the planar closed second end of the cylinder guard.

9. The improved lock mechanism according to claim 7 wherein a threaded screw is received in the receiver to secure the knob-set cylinder in the receiver.

10. The improved lock mechanism according to claim 7 wherein including a torque bar secured to the driver end of the plug.

11. The improved lock mechanism according to claim 10 wherein the cylinder guard body has an annular support plate at its first end with an outer circumference and inner circumference and a first side and second side, a planar closed second end with an outer circumference, a cylindrical frame having an inner side and an outer side extending from the outer circumference of the planar closed second end to the inner circumference of the first end, and a plurality of ribs extending radially outward from the outer side of the cylindrical frame and extending axially from the first side of the annular support plate toward the planar closed second end of the cylinder guard.

12. An improved lock mechanism comprising:

an anti-pry shield having a hollow body with first and second opposing ends, a cylindrical shield at the first end and a cylindrical flange at the second end, the cylindrical shield having diametrically opposing cutouts open to the first end and adapted to receive the actuator of a dead bolt;

a knob-set cylinder having a plug with a key end and a driver end;

a monolithic cylinder guard having a body with an annular support plate at its first end with an outer circumference and inner circumference and a first side and second side, a planar closed second end with an outer circumference, a cylindrical frame having an inner side and an outer side extending from the outer circumference of the planar closed second end to the inner circumference of the first end, and a plurality of ribs extending radially outward from the outer side of the cylindrical frame and extending axially from the first side of the annular support plate toward the planar closed second end of the cylinder guard, the body having a beveled exterior side wall between a first end and a second end, the second end having a bore, a receiver having a cavity open to the first end, the cavity adapted to receive the knob-set cylinder from the first end, the cavity open to the bore in the second end, the bore adapted to receive the key end of the plug, an annular groove around the receiver open to the first end and adapted to receive the cylindrical flange of the anti-pry shield, the monolithic cylinder guard receiving a threaded screw on the receiver to secure the knob-set cylinder in the receiver; and a cover having a beveled exterior side wall between an open first end and a covered second end, the cover permanently secured to and covering the beveled exterior side wall and second end of the monolithic cylinder guard, the covered second end of the cover having a bore coaxial with the bore in the second end of the monolithic cylinder guard and the plug of the knob-set cylinder.

13. The improved lock mechanism according to claim 12 including a torque bar secured to the driver end of the plug.

* * * * *